US005865394A

United States Patent [19]

Giese et al.

[11] Patent Number: 5,865,394

[45] Date of Patent: Feb. 2, 1999

[54] SELF CONTAINED BOBBIN WINDER

[76] Inventors: Thomas G. M. Giese, 5949 - 188A Street, Cloverdale, British Columbia, Canada, V3S 7M1; Heather E. Marshall, 2/41 Menzies Drive, Pacific Paradise, Australia, 4564

[21] Appl. No.: 910,071

[22] Filed: Aug. 12, 1997

[51] Int. Cl.[6] ..... B65H 54/40; B65H 49/00

[52] U.S. Cl. ..... 242/485.7; 242/128; 242/484.8

[58] Field of Search ..... 242/20, 22, 39, 242/128, 132, 140, 474.3, 474.4, 484.8, 485.7, 486.8

[56] References Cited

U.S. PATENT DOCUMENTS

| | | | |
|---|---|---|---|
| 2,377,799 | 6/1945 | Markwood | 242/128 |
| 3,122,113 | 2/1964 | Edwards | 242/128 X |
| 3,461,659 | 8/1969 | Greason | 242/128 X |
| 3,581,687 | 6/1971 | Meier | 112/279 |
| 4,606,507 | 8/1986 | Lerch et al. | 242/484.8 |
| 4,646,982 | 3/1987 | Spring | 242/484.8 |
| 5,042,735 | 8/1991 | Vogel et al. | 242/18 R |

*Primary Examiner*—Michael Mansen

[57] ABSTRACT

A self contained bobbin winder including at least one spool rod coupled at an end thereof to a self contained housing. Each rod is adapted to removably insert within an axially aligned aperture formed in a spool of thread. At least one bobbin rod is coupled to the housing. Each bobbin rod is adapted to removably insert within an axially aligned aperture formed in a bobbin for winding thread therearound. At least one motor is adapted to rotate the bobbin upon the activation thereof. Also included is at least one switch coupled between a power source and motor. The switch has a first actuated orientation for providing power to the motors thereby rotating the bobbin rods and a deactivated orientation for precluding power from being supplied thereto. Finally, a cutoff mechanism is included to preclude operation of the device once the bobbin is fully wound with thread.

1 Claim, 3 Drawing Sheets

SELF CONTAINED BOBBIN WINDER

BACKGROUND OF THE INVENTION

1. Field of the Invention

The present invention relates to a new and improved self contained bobbin winder and, more particularly, pertains to winding bobbins without the use of a sewing machine.

2. Description of the Prior Art

The use of bobbin winders is known in the prior art. More specifically, bobbin winders heretofore devised and utilized for winding bobbins are known to consist basically of familiar, expected, and obvious structural configurations, notwithstanding the myriad of designs encompassed by the crowded prior art which has been developed for the fulfillment of countless objectives and requirements.

The prior art discloses a large number of bobbin winders. By way of example, U.S. Pat. No. 5,042,735 to Vogel et al. discloses an industrial textile machine which features a supplemental bobbin rewinding device. U.S. Pat. No. 4,646,982 to Spring discloses a bobbin winding device which is incorporatable with a household sewing machine. U.S. Pat. No. 4,613,090 to Sugioka discloses a yarn winding apparatus which teaches the use of an automatic bobbin changing provision. Lastly, U.S. Pat. No. 5,058,818 to Hachnel et al.; U.S. Pat. No. 4,002,130 to Rovin et al.; and U.S. Pat. No. 3,581,687 to Meier are provided as being of general interest.

In this respect, the self contained bobbin winder according to the present invention substantially departs from the conventional concepts and designs of the prior art, and in doing so provides an apparatus primarily developed for the purpose of winding bobbins without the use of a sewing machine.

Therefore, it can be appreciated that there exists a continuing need for a new and improved self contained bobbin winder which can be used for winding bobbins without the use of a sewing machine. In this regard, the present invention substantially fulfills this need.

SUMMARY OF THE INVENTION

In view of the foregoing disadvantages inherent in the known types of bobbin winders now present in the prior art, the present invention provides an improved self contained bobbin winder. As such, the general purpose of the present invention, which will be described subsequently in greater detail, is to provide a new and improved self contained bobbin winder and methods which have all the advantages of the prior art and none of the disadvantages.

To attain this, the present invention essentially comprises a housing having an upper surface, a planar lower surface, and a periphery formed therebetween defining an interior space. The housing further has a pair of arcuate recesses formed at opposed sides thereof for receiving spools of thread. A pair of elongated, collapsible spool rods are each pivotally coupled at an end thereof adjacent to each arcuate recess. Each rod is adapted to removably insert within an axially aligned aperture formed in the spools of thread. A removable circular flange with a diameter larger than that of the spools of thread is included for containing the spool when removing thread therefrom. A pair of short bobbin rods are vertically coupled to the upper surface of the housing adjacent to each arcuate recess. Each rod is adapted to removably insert within an axially aligned aperture formed in a bobbin for winding thread therearound. A guide channel is formed in the upper surface of the housing guiding thread between the spool and bobbin during the transfer thereof. A pair of motors are positioned within the interior space of the housing adjacent to each of the bobbin rods. The motors are adapted to rotate the bobbins upon the activation thereof. A pair of manually actuated switches are coupled between the each motor and a power source. Each manually actuated switch has a first actuated orientation for providing power to the motors thereby rotating the bobbin rods and a deactivated orientation for precluding power from being supplied thereto. A pair of automatic cutoff switches are coupled between the power source and motor. Each cutoff switch has a first orientation for allowing power to be supplied to each motor upon the actuation of the corresponding manually actuated switch. The cutoff switch further has a second orientation precluding power from being supplied to the motor when the bobbin is fully wound with thread.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self contained bobbin winder which has all the advantages of the prior art bobbin winders.

It is another object of the present invention to provide a new and improved self contained bobbin winder which may be easily and efficiently manufactured and marketed.

It is a further object of the present invention to provide a new and improved self contained bobbin winder which is of a durable and reliable construction.

An even further object of the present invention is to provide a new and improved self contained bobbin winder which is susceptible of a low cost of manufacture with regard to both materials and labor, and which accordingly is then susceptible of low prices of sale to the consuming public, thereby making such self contained bobbin winder economically available to the buying public.

Still yet another object of the present invention is to provide a new and improved self contained bobbin winder which provides in the apparatuses and methods of the prior art some of the advantages thereof, while simultaneously overcoming some of the disadvantages normally associated therewith.

Even still another object of the present invention is to provide a self contained bobbin winder which provides a device for winding bobbins without the use of a sewing machine.

Lastly, it is an object of the present invention to provide a self contained bobbin winder comprising at least one spool rod coupled at an end thereof to a self contained housing. Each rod is adapted to removably insert within an axially aligned aperture formed in a spool of thread. At least one bobbin rod is coupled to the housing. Each bobbin rod is adapted to removably insert within an axially aligned aperture formed in a bobbin for winding thread therearound. At least one motor is adapted to rotate the bobbin upon the activation thereof. Also included is at least one switch coupled between a power source and motor. The switch has a first actuated orientation for providing power to the motors thereby rotating the bobbin rods and a deactivated orientation for precluding power from being supplied thereto. Finally, a cutoff mechanism is included to preclude operation of the device once the bobbin is fully wound with thread.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
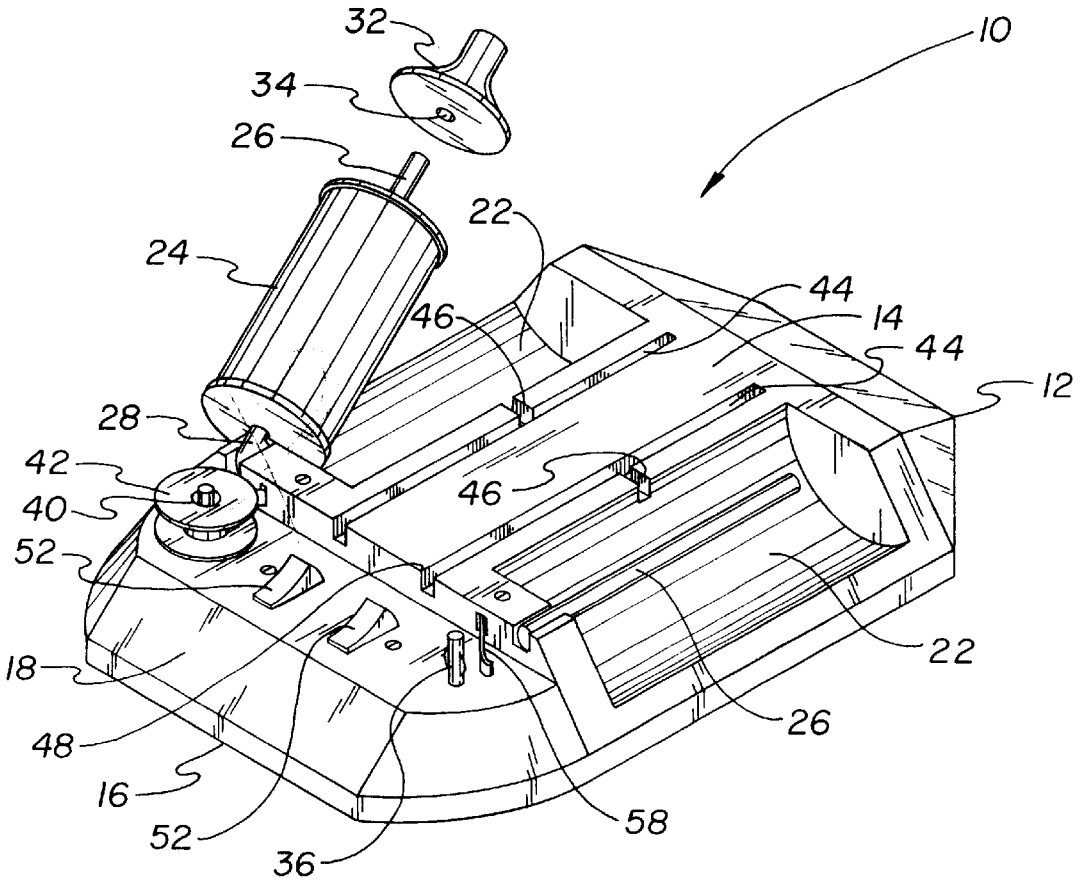
FIG. 1 is a perspective illustration of the preferred embodiment of the self contained bobbin winder constructed in accordance with the principles of the present invention.
Figure 2:
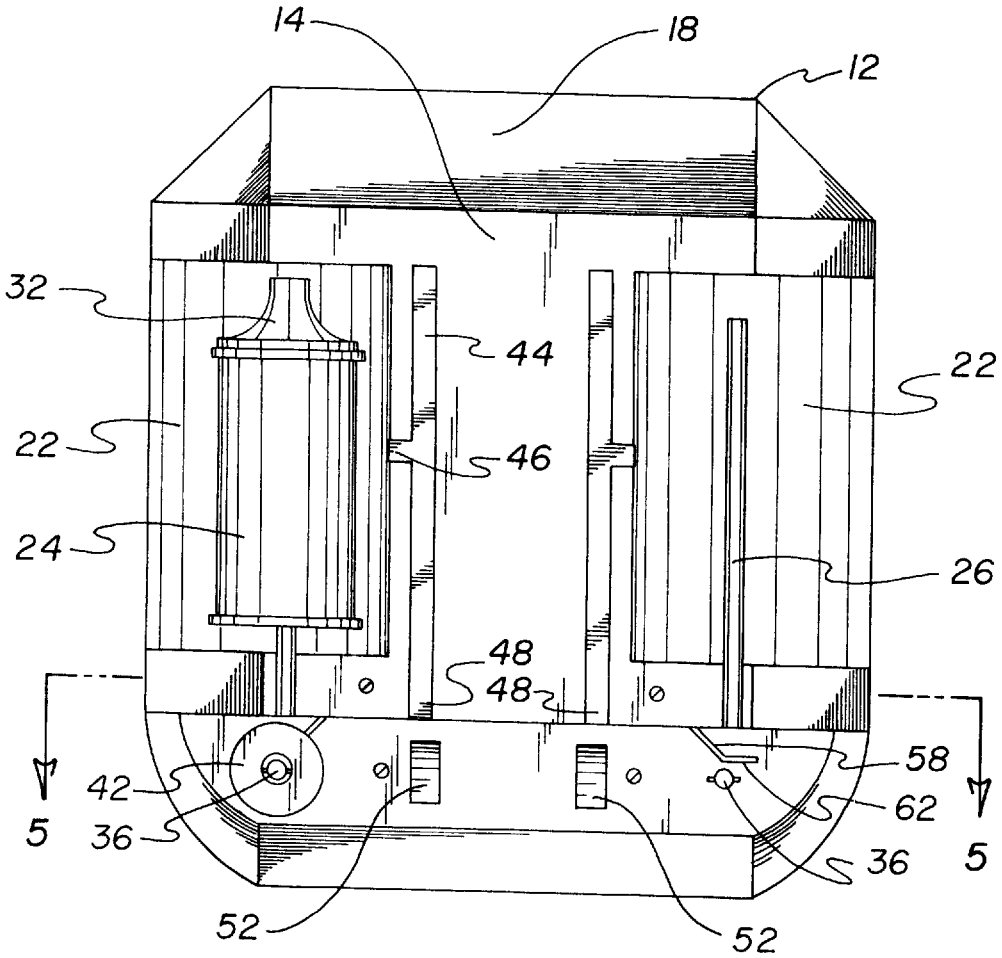
FIG. 2 is a top plan view of the self-contained bobbin winder.
Figure 3:
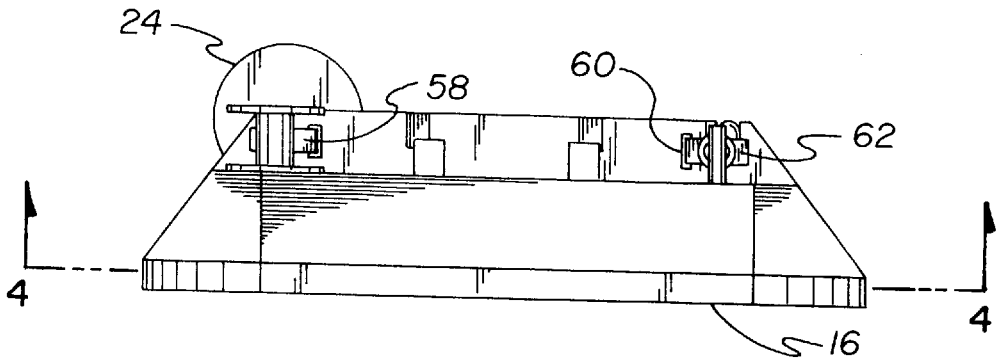
FIG. 3 is a side plan view of the present invention.
Figure 4:
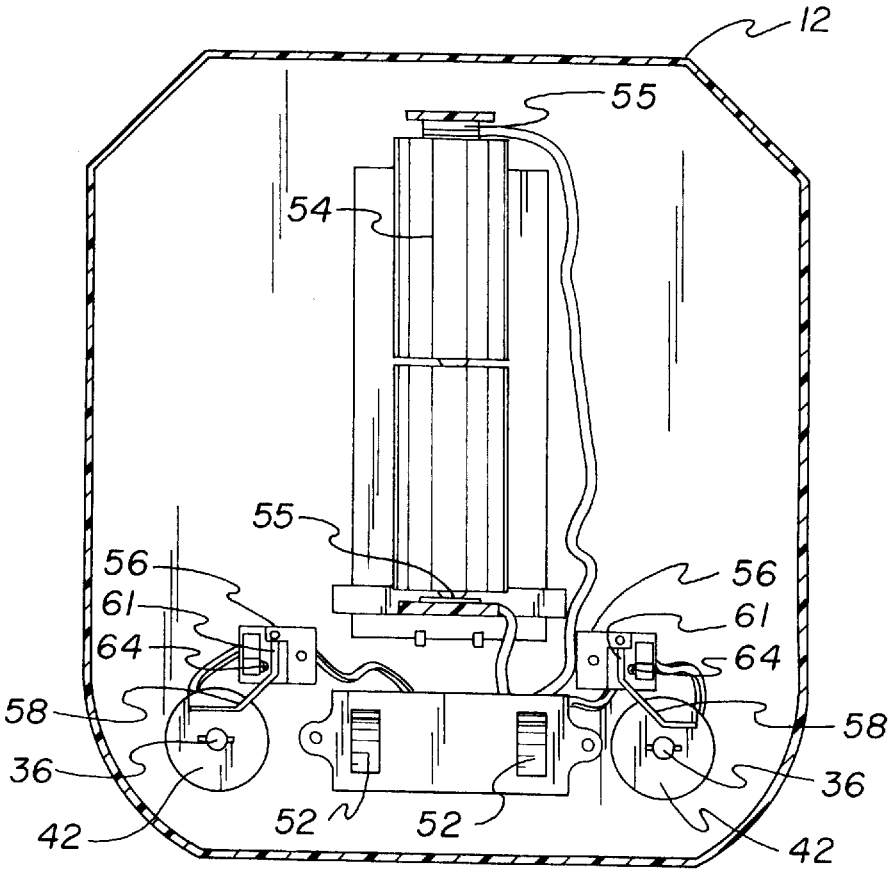
FIG. 4 is a cross-sectional view taken along line 4—4 shown in FIG. 3.
Figure 5:
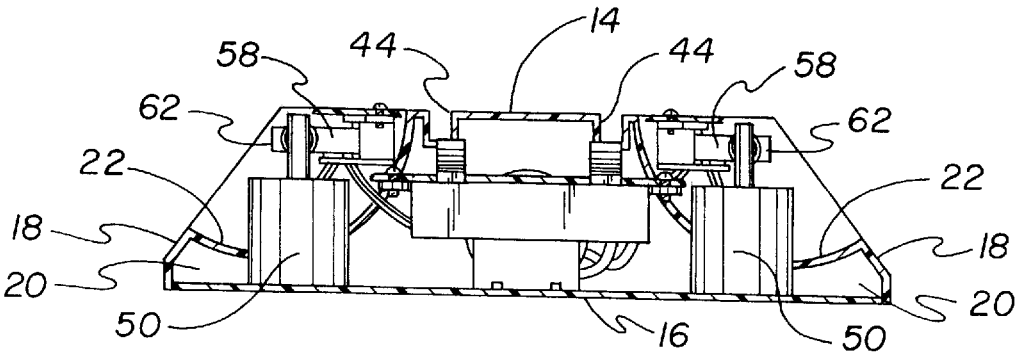
FIG. 5 is a cross-sectional view taken along line 5—5 shown in FIG. 2.

With reference now to the drawings, and in particular to FIG. 1 thereof, the preferred embodiment of the new and improved self contained bobbin winder embodying the principles and concepts of the present invention and generally designated by the reference numeral 10 will be described.

The present invention, the new and improved self contained bobbin winder is a system 10 comprised of a plurality of components. In their broadest context, the components include a housing, spool rod, and motor driven bobbin rod. Each of the individual components is specifically configured and correlated one with respect to the other so as to attain the desired objectives.

More specifically, the system 10 of the present invention includes a housing 12 having an upper surface 14, a planar lower surface 16, and a periphery 18 formed therebetween defining an interior space 20. The periphery has side edges which are no longer than eight inches in length. The housing 12 further has a pair of arcuate recesses 22 formed at opposed sides thereof for receiving spools 24 of thread. The recesses extend radially inward within the housing for distance equivalent to one-half the size of the diameter of the spool.

Further included is a pair of elongated, collapsible spool rods 26 each pivotally coupled at an end thereof adjacent to each arcuate recess. Each rod 26 is adapted to removably insert within an axially aligned aperture 28 formed in the spool 30 of thread. Each rod 26 has a first upstanding orientation for loading the spool thereon and a second horizontal orientation for removing thread from the spool.

For constraining the spool during operation, a circular flange 32 is included with a diameter larger than that of the spools of thread. The flange has an aperture 34 with a size corresponding to that of the spool rods for removably coupling thereto, thereby containing the spool when removing thread therefrom. The flange rests upon the recess when the spool rod is in a horizontal orientation.

Also included is a pair of short bobbin rods 36 vertically coupled to the upper surface 14 of the housing 12 adjacent to each arcuate recess 22. Each bobbin rod 36 is adapted to removably insert within an axially aligned aperture 40 formed in a bobbin 42 for winding thread therearound.

A guide channel 44 is formed in the upper surface 14 of the housing 12 with a first end 46 adjacent the spool of thread and a second end 48 adjacent to the bobbin. The guide channel 44 is adapted to guide the thread between the spool and bobbin during the transfer thereof.

A pair of motors 50 are positioned within the interior space 20 of the housing 12 adjacent each of the bobbin rods 36. The motors 50 are adapted to rotate the bobbin rods upon the activation thereof.

A pair of manually actuated switches 52 are each coupled between each motor 50 and a power source 54. The power source preferably consists of a plurality of batteries 55, but may also comprise a standard power receptacle. Each manually actuated switch 52 has a first actuated orientation for providing power to the motors thereby rotating the bobbin rods and a deactivated orientation for precluding power from being supplied thereto.

A pair of cutoff switches 56 are coupled between the power source 54 and motor 50. Each cutoff switch comprises a generally L-shaped lever 58 extending through an aperture 60 formed in the upper surface of the housing. Each lever 58 has a first end 61 pivotally coupled within the interior space of the housing and a second end 62 extending tangentially adjacent the bobbin rod. Each cutoff switch includes a cutoff contact 64 positioned adjacent the first end of the lever within the interior space. Each cutoff switch further has a first orientation wherein the second end of the lever is proximate the bobbin rod for allowing power to be supplied to each motor upon the actuation of the corresponding manually actuated switch. The cutoff switch further has a second orientation wherein the thread wrapped around the bobbin forces the second end of the lever distant from the bobbin rod thus forcing the first end of the lever to abut the contact thereby returning the manually actuated switch to the second orientation thereof.

Operation and use of the self-contained bobbin winder is facilitated by the amalgamation of the foregoing components. To prepare the device for use, the spool rod is positioned in an upstanding orientation so a spool wound with thread can be inserted thereon. The spool rod is then situated in a horizontal orientation and the thread is lead through guide channel. Finally, a bobbin is inserted on to the bobbin rod and the thread wrapped a few times therearound. To use the device, the manually actuated switch may then be activated effecting winding of the thread upon the bobbin until the bobbin is full whereat the cutoff lever abuts the contact thereby effecting deactivation of the device. Deactivation circuitry employed by the device is commonly known and commercially available.

The self-contained bobbin winder allows a user to wind a bobbin with a correct thread without having to dismantle the bobbin currently employed by a sewing machine. The present invention thus allows continued use of the machine for purposes other than winding bobbins. Businesses and homemakers alike could employ the instant invention to maximize the use of the sewing machine and maintain continuity of stitching.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self contained bobbin winder comprising, in combination:

a housing having an upper surface, a planar lower surface, and a periphery formed therebetween defining an interior space, the housing further having a pair of arcuate recesses formed at opposed sides thereof for receiving spools of thread;

a pair of elongated, collapsible spool rods each pivotally coupled at an end thereof adjacent to each arcuate recess, each rod adapted to removably insert within an axially aligned aperture formed in a spool of the thread, each rod having a first upstanding orientation for loading the spool thereon and a second horizontal orientation for removing thread from the spool;

a circular flange with a diameter larger than that of the spools of thread, the flange having an aperture with a size corresponding to that of the spool rods for removably coupling with the rod thereby containing the spool when removing thread therefrom;

a pair of short bobbin rods vertically coupled to the upper surface of the housing adjacent to each arcuate recess, each bobbin rod adapted to removably insert within an axially aligned aperture formed in a bobbin for winding thread therearound;

a guide channel formed in the upper surface of the housing parallel with the pair of arcuate recesses with a first end adjacent the spool of thread and a second end adjacent a bobbin positioned on the bobbin rods, the guide channel adapted to guide thread between the spool and bobbin during the transfer thereof;

a power source;

a pair of motors positioned within the interior space of the housing adjacent each of the bobbin rods, the motors adapted to rotate the bobbin rods upon the activation thereof;

a pair of manually actuated switches coupled between each motor and the power source, each manually actuated switch having a first actuated orientation for providing power to the motors thereby rotating the bobbin rods and a deactivated orientation for precluding power from being supplied thereto; and a pair of cutoff switches coupled between the power source and the pair of motors, each cutoff switch comprising a generally L-shaped lever extending through an aperture formed in the upper surface of the housing, each lever having a first end pivotally coupled within the interior space of the housing and a second end extending tangentially adjacent the bobbin rod, each cutoff switch including a cutoff contact positioned adjacent the first end of the lever within the interior space, each cutoff switch further having a first orientation wherein the second end of the lever is close to the bobbin rod for allowing power to be supplied to each motor upon the actuation of the corresponding manually actuated switch, each cutoff switch further having a second orientation wherein the thread wrapped around the bobbin forces the second end of the lever distant from the bobbin rod thus forcing the first end of the lever to abut the contact thereby returning the manually actuated switch to the second orientation thereof;

whereby the spool wound with thread may be inserted on to the spool rod and the thread lead through guide channel and finally wound about the bobbin inserted on to the bobbin rod, the manually actuated switch may then be activated effecting winding of the thread upon the bobbin until the bobbin is full whereat the cutoff lever abuts the contact thereby effecting deactivation of the device.

* * * * *